US012263997B2

(12) United States Patent
Moreno Brociner et al.

(10) Patent No.: US 12,263,997 B2
(45) Date of Patent: Apr. 1, 2025

(54) CLOSURE SYSTEM WITH BARRIER LAYER

(71) Applicant: Winpak Ltd., Winnipeg (CA)

(72) Inventors: Manuel Jose Moreno Brociner, Winnipeg (CA); Mustafa Bilgen, Fayettville, GA (US); Olivier Yves Muggli, Winnipeg (CA); Ashley Robert Andrews, Kleefeld (CA)

(73) Assignee: Winpak Ltd., Winnipeg (CA)

( * ) Notice: Subject to any disclaimer, the term of this patent is extended or adjusted under 35 U.S.C. 154(b) by 0 days.

(21) Appl. No.: 17/654,670

(22) Filed: Mar. 14, 2022

(65) Prior Publication Data

US 2022/0297900 A1 Sep. 22, 2022

Related U.S. Application Data

(60) Provisional application No. 63/161,657, filed on Mar. 16, 2021.

(51) Int. Cl.
*B65D 47/12* (2006.01)
*B65D 39/16* (2006.01)
(Continued)

(52) U.S. Cl.
CPC ..... *B65D 47/122* (2013.01); *B65D 39/16* (2013.01); *B65D 55/16* (2013.01); *B65D 75/008* (2013.01);
(Continued)

(58) Field of Classification Search
CPC ..... B65D 47/122; B65D 39/16; B65D 55/16; B65D 75/008; B65D 75/5883; B65D 2575/586; B65D 39/08
(Continued)

(56) References Cited

U.S. PATENT DOCUMENTS 2,501,849 A * 3/1950 Krebs ..... B65D 41/14 215/261
3,245,569 A 4/1966 Helmut
(Continued)

FOREIGN PATENT DOCUMENTS

DE 921134 C 12/1954
DE 4009656 A1 * 10/1991 ..... B65D 35/12
(Continued)

OTHER PUBLICATIONS

The International Search Report and the Written Opinion of the International Searching Authority, International Application No. PCT/IB2022/052269, pp. 1-9, dated Jun. 7, 2022.
(Continued)

*Primary Examiner* — Don M Anderson
*Assistant Examiner* — Eric C Baldrighi
(74) *Attorney, Agent, or Firm* — Bond, Schoeneck & King, PLLC

(57) ABSTRACT

A closure system including a cap and a spout, where the cap and/or spout contain at least one discrete layer of barrier material. In one example, the spout includes a conduit and a seal member, the conduit being arranged about an imaginary axis and the seal member having one or more surfaces configured to be secured to a container. The cap includes an inner circumferential surface, the inner circumferential surface arranged to encompass the conduit. The cap also includes a first discrete layer of thermoplastic resin and a first discrete layer of barrier material and the seal member includes a second discrete layer of thermoplastic resin and a second discrete layer of barrier material.

22 Claims, 10 Drawing Sheets

(51) Int. Cl.
*B65D 55/16* (2006.01)
*B65D 75/00* (2006.01)
*B65D 75/58* (2006.01)

(52) U.S. Cl.
CPC .... *B65D 75/5883* (2013.01); *B65D 2575/586* (2013.01)

(58) Field of Classification Search
USPC ..... 215/347
See application file for complete search history.

(56) References Cited

U.S. PATENT DOCUMENTS

| | | | | | |
|---|---|---|---|---|---|
| 4,347,939 | A * | 9/1982 | Upton | B65D 55/022 | 215/341 |
| 4,872,573 | A * | 10/1989 | Johnson | B65D 41/3447 | 215/347 |
| 6,722,531 | B2 * | 4/2004 | Matsuo | B65D 35/12 | 222/105 |
| 9,809,370 | B2 * | 11/2017 | Bellmore | B65D 75/5877 | |
| 10,569,940 | B2 * | 2/2020 | Davies | B65D 51/242 | |
| 10,773,491 | B2 * | 9/2020 | Sato | C09J 175/04 | |
| 2002/0079241 | A1 * | 6/2002 | Matsuo | B65D 75/5883 | 206/277 |
| 2005/0040181 | A1 * | 2/2005 | Kurosawa | B65D 75/5883 | 222/92 |
| 2011/0135223 | A1 * | 6/2011 | Suzuki | B65D 75/5883 | 383/114 |
| 2015/0225107 | A1 * | 8/2015 | Ross | B65D 39/08 | 413/4 |
| 2017/0008207 | A1 | 1/2017 | Tamarindo | | |
| 2017/0043911 | A1 * | 2/2017 | Kinouchi | B65D 47/06 | |
| 2017/0121085 | A1 | 5/2017 | Ichikawa et al. | | |
| 2017/0225852 | A1 | 8/2017 | Ohkubo et al. | | |
| 2019/0241339 | A1 | 8/2019 | Sako et al. | | |

FOREIGN PATENT DOCUMENTS

| | | | | | |
|---|---|---|---|---|---|
| EP | 1700794 | A1 | | 9/2006 | |
| EP | 3063079 | A | | 9/2016 | |
| FR | 2892100 | A1 | | 4/2007 | |
| GB | 191129017 | A | * | 2/1999 | B65D 41/0485 |
| JP | 2002211594 | A | * | 7/2002 | B65D 35/12 |
| JP | 2002255200 | A | * | 9/2002 | B65D 35/12 |
| JP | 2003291990 | A | * | 10/2003 | |
| JP | 2004290362 | A | * | 10/2004 | |
| WO | WO-2005092603 | A1 | * | 10/2005 | B29C 43/021 |
| WO | 2020113219 | A1 | | 6/2020 | |
| WO | 2020221801 | A1 | | 11/2020 | |

OTHER PUBLICATIONS

Extended European Search Report, EP Patent Application No. 22770713.0, dated Feb. 4, 2025, pp. 1-10.

* cited by examiner

CLOSURE SYSTEM WITH BARRIER LAYER

CROSS-REFERENCE TO RELATED APPLICATIONS

This application claims priority to U.S. Provisional Patent Application Ser. No. 63/161,657, filed on Mar. 16, 2021, which application is hereby incorporated by reference in its entirety.

FIELD OF THE DISCLOSURE

The present disclosure is directed generally to closure systems for containers used primarily for storing and dispensing solid, liquid, or semi-liquid products such as foodstuffs, hygiene, or healthcare products. Specifically, the present disclosure is directed to closure systems with one or more barrier layers.

BACKGROUND

Squeezable food containers, e.g., flexible pouches, typically include a spout or straw configured to facilitate access to stored foodstuffs within the body of the container. In some examples, these containers can also be used to store fermentable materials such as milks/yogurts, etc., and thus preventing migration of oxygen and moisture from outside of the container to inside of the container is important to prevent spoilage of the contents stored within the container. Additionally, most containers have straws that include externally facing threads which secure a cap to the straw, however these externally facing threads contact the inside of the user's mouth while interacting with the container, and result in a bad in-mouth feel for the user.

SUMMARY OF THE DISCLOSURE

The present disclosure provides a closure system including a cap and a spout, where the cap and/or spout contain at least one discrete layer of barrier material. In one example, the spout includes a conduit and a seal member, the conduit being arranged about an imaginary axis and the seal member having one or more surfaces configured to be secured to a container. The cap includes an inner circumferential surface where the inner circumferential surface is arranged to encompass the conduit. The cap also includes a first discrete layer of thermoplastic resin and a first discrete layer of barrier material, and in some examples, the seal member includes a second discrete layer of thermoplastic resin and a second discrete layer of barrier material.

As will be described herein, in some examples, the discrete layers of barrier material can be positioned as close as possible to the interior surface of each component while also maintaining at least a portion of thermoplastic material between the barrier material and the foodstuffs within the container to limit or eliminate migration of oxygen to the foodstuffs while not exposing the barrier material to the foodstuffs directly. Additionally, in some examples, threading between the cap and the conduit is provided on the inner circumferential surface of the conduit providing a more satisfying in-mouth feel to the user over conduits, spouts, or straws that have external threads. Additionally, the orientation of conduit threading and cap threading discussed herein prevents moisture/water accumulation during or after any pasteurization processes. In some examples, the cap can include a protrusion arranged to substantially fill the inner volume of the conduit while secured to the conduit which limits or substantially lessens oxygen present in the internal volume of conduit that may have accumulated during the manufacturing, forming, or filling process that could significantly contribute to the spoiling of foodstuffs or negatively effect a pasteurization process of the foodstuffs. Additionally, the closure system described herein provides a narrow overall cap design that reduces overall cap size while maintaining sufficient length and width dimensions to avoid the cap being a choking hazard for children and allows for a higher packing efficiency for shipping and product display.

In one example, a closure system for containers of foodstuffs is provided, the closure system including a spout, the spout having a conduit and a seal member, the conduit arranged about an imaginary axis and the seal member having one or more surfaces configured to be secured to a container, and a cap having an inner circumferential surface, the inner circumferential surface arranged to encompass the conduit, the cap including a first discrete layer of thermoplastic resin and a first discrete layer of barrier material.

In one aspect, the seal member includes a second discrete layer of thermoplastic resin and a second discrete layer of barrier material.

In one aspect, one or more surfaces of the seal member are secured to the container via heat sealing, conduction sealing, induction sealing, adhesive sealing, ultrasonic bonding, welding, laser sealing, or any combination thereof.

In one aspect, the first discrete layer of thermoplastic resin is selected from at least one of: Acrylonitrile Butadiene Styrene (ABS), Acrylic, High Density Polyethylene (HDPE), Polypropylene, Polyethylene, Polystyrene, Polyvinyl Chloride (PVC), Polyethylene Terephthalate (PET), Polycarbonate, Polylactic Acid, Thermoplastic Starch, Polyhydroxyalkanoate, Polyhydroxybutyrate, Polybutylene succinate, Polyamide or any combination thereof.

In one aspect, the first discrete layer of barrier material is selected from at least one of: Polyamide, Ethylene Vinyl Alcohol (EVOH), Polyvinyl Alcohol, Thermoplastic Starch, cellulose nano crystals, nano clay, or any combination thereof.

In one aspect, the cap has a protrusion extending in a first direction, the protrusion arranged to substantially fill an inner volume of the conduit.

In one aspect, an upper section of the protrusion includes first threading configured to engage with second threading disposed on an inner circumferential surface of the conduit.

In an aspect, a lower section of the protrusion includes a morse taper from a first diameter to a second diameter less than the first diameter.

In an aspect, the protrusion terminates at a flat surface substantially orthogonal with the imaginary axis.

In an aspect, the cap has a lower ring configured to engage with the conduit and/or the seal member, and a body portion configured to engage with and close an aperture of the conduit.

In an aspect, the lower ring is secured to the body portion via one or more tethers.

In an aspect, the one or more tethers are integrally formed with the lower ring and the body portion of the cap.

In an aspect, the body portion of the cap includes one or more tabs.

In an aspect, the one or more tabs each include an aperture.

In an aspect, the one or more tabs measure at least 31.75 mm in length.

In an aspect, the conduit comprises a third layer of thermoplastic resin and a third layer of barrier material.

In an aspect, the container comprises a container barrier material or a discrete layer of container barrier material.

In another example, a closure system for containers of foodstuffs is provided, the closure system including: a spout, the spout having a conduit and a seal member, the conduit arranged about an imaginary axis and the seal member having one or more surfaces configured to be secured to a container, and a cap having an inner circumferential surface, the inner circumferential surface arranged to encompass the conduit, the cap including a first discrete layer of thermoplastic resin and a first discrete layer of barrier material, wherein the seal member includes a second discrete layer of thermoplastic resin and a second discrete layer of barrier material.

In an aspect, the cap has a protrusion extending in a first direction, the protrusion arranged to substantially fill an inner volume of the conduit, wherein a lower section of the protrusion includes a morse taper from a first diameter to a second diameter less than the first diameter, and wherein the protrusion terminates at a flat surface substantially orthogonal with the imaginary axis.

In an aspect, the cap has a lower ring configured to engage with the conduit and/or the seal member, and a body portion configured to engage with and close an aperture of the conduit.

In an aspect, the lower ring is secured to the body portion via one or more tethers and wherein the one or more tethers are integrally formed with the lower ring and the body portion of the cap.

In an aspect, the thermoplastic resin of the first discrete layer of thermoplastic resin or the second discrete layer of thermoplastic resin is selected from at least one of: Acrylonitrile Butadiene Styrene (ABS), Acrylic, High Density Polyethylene (HDPE), Polypropylene, Polyethylene, Polystyrene, Polyvinyl Chloride (PVC), Polyethylene Terephthalate (PET), Polycarbonatepolylactic Acid, Thermoplastic Starch, Polyhydroxyalkanoate, Polyhydroxybutyrate, Polybutylene succinate, Polyamide, or any combinations thereof; and wherein the barrier material of first discrete layer of barrier material and the second discrete layer of barrier material is selected from at least one of: Polyamide, Ethylene Vinyl Alcohol (EVOH), Polyvinyl Alcohol, Thermoplastic Starch, Cellulose nano crystals, nano clay, or any combination thereof.

These and other aspects of the various embodiments will be apparent from and elucidated with reference to the embodiment(s) described hereinafter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the various embodiments.

DETAILED DESCRIPTION OF EMBODIMENTS

The present disclosure provides a closure system including a cap and a spout, where the cap and/or spout contain at least one discrete layer of barrier material. In one example, the spout includes a conduit and a seal member, the conduit being arranged about an imaginary axis and the seal member having one or more surfaces configured to be secured to a container. The cap includes an inner circumferential surface where the inner circumferential surface is arranged to encompass the conduit. The cap also includes a first discrete layer of thermoplastic resin and a first discrete layer of barrier material, and in some examples, the seal member includes a second discrete layer of thermoplastic resin and a second discrete layer of barrier material.

Figure 1:
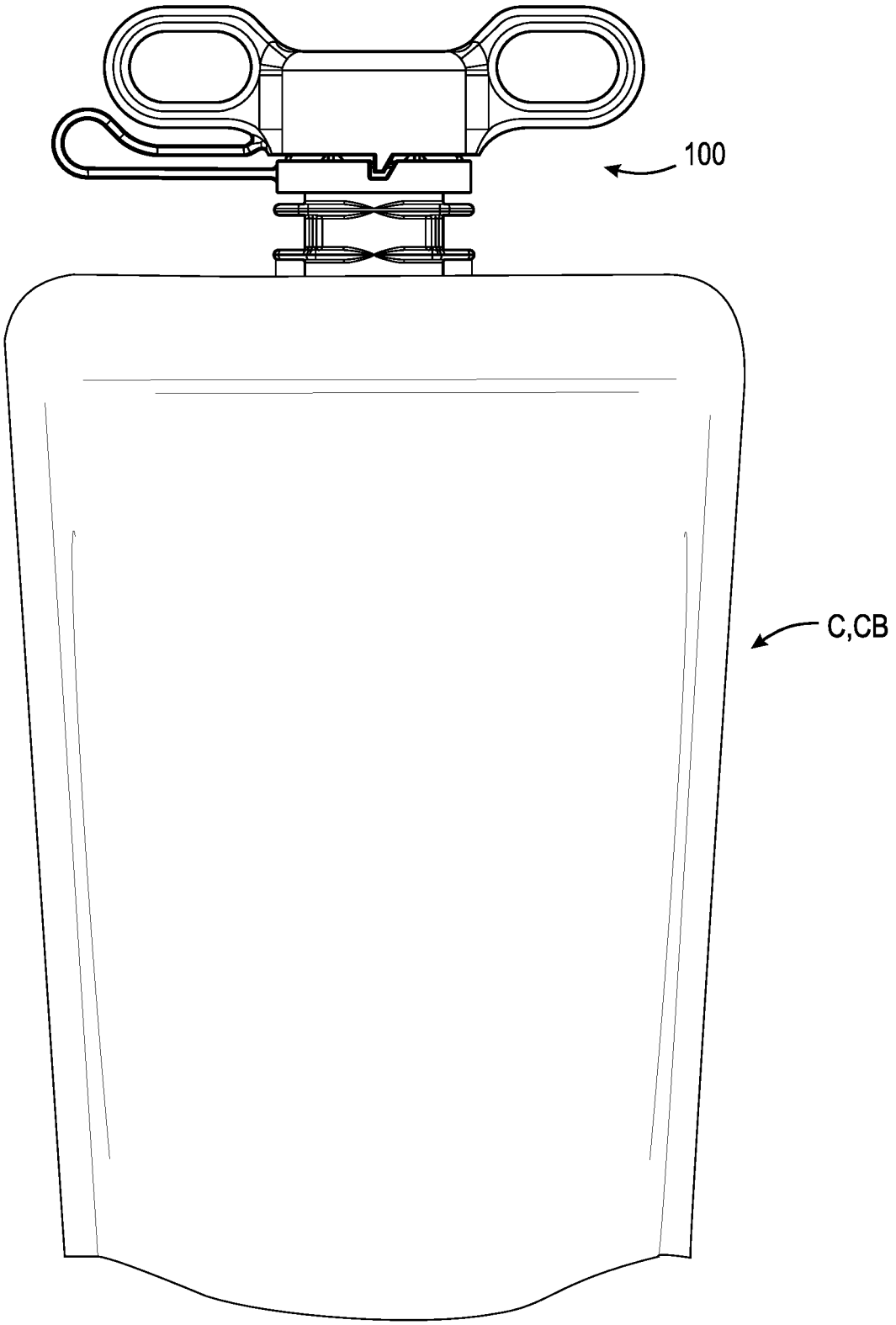
FIG. 1 is a front perspective view of a container and closure system according to the present disclosure.

Transitioning now to the figures, FIG. 1 illustrates a container C with a closure system 100 according to the present disclosure. Container C is intended to be a flexible pouch, pod, flask, tetra pack, or any other container configured to receive solid, liquid, and semi-liquid foodstuffs. Container C can be made of paper, metal foil, or plastics such as polypropylene, polyethylene, or polystyrene, or any other flexible, water-resistant or water-proof material. In some examples, container C comprises a container barrier material CB or may include a discrete layer of container barrier material CB, where the container barrier material is selected from Polyamide, Ethylene Vinyl Alcohol (EVOH), Polyvinyl Alcohol, Thermoplastic Starch, cellulose nano crystals, nano clay, or any combination thereof. In some examples, container C is made of polypropylene and is configured to stand upright on a substantially planar surface without additional support. In other words, container C is intended to be made of a flexible material capable of retaining enough rigidity that it is still capable of free standing (i.e., standing without any support member). As will be discussed below, container C is intended to be sealed to a closure system, e.g., closure system 100, such that the closure system 100 is configured to allow for egress of foodstuffs stored in container C while mitigating migration of oxygen from the outside container C inward to the foodstuffs. Container C is configured to store and dispense various solids, liquids, semi-fluids, liquids with solid parts, or other foodstuffs including, but not limited to yogurt, milk, baby food, or fruit or vegetable purees.

Figure 2:
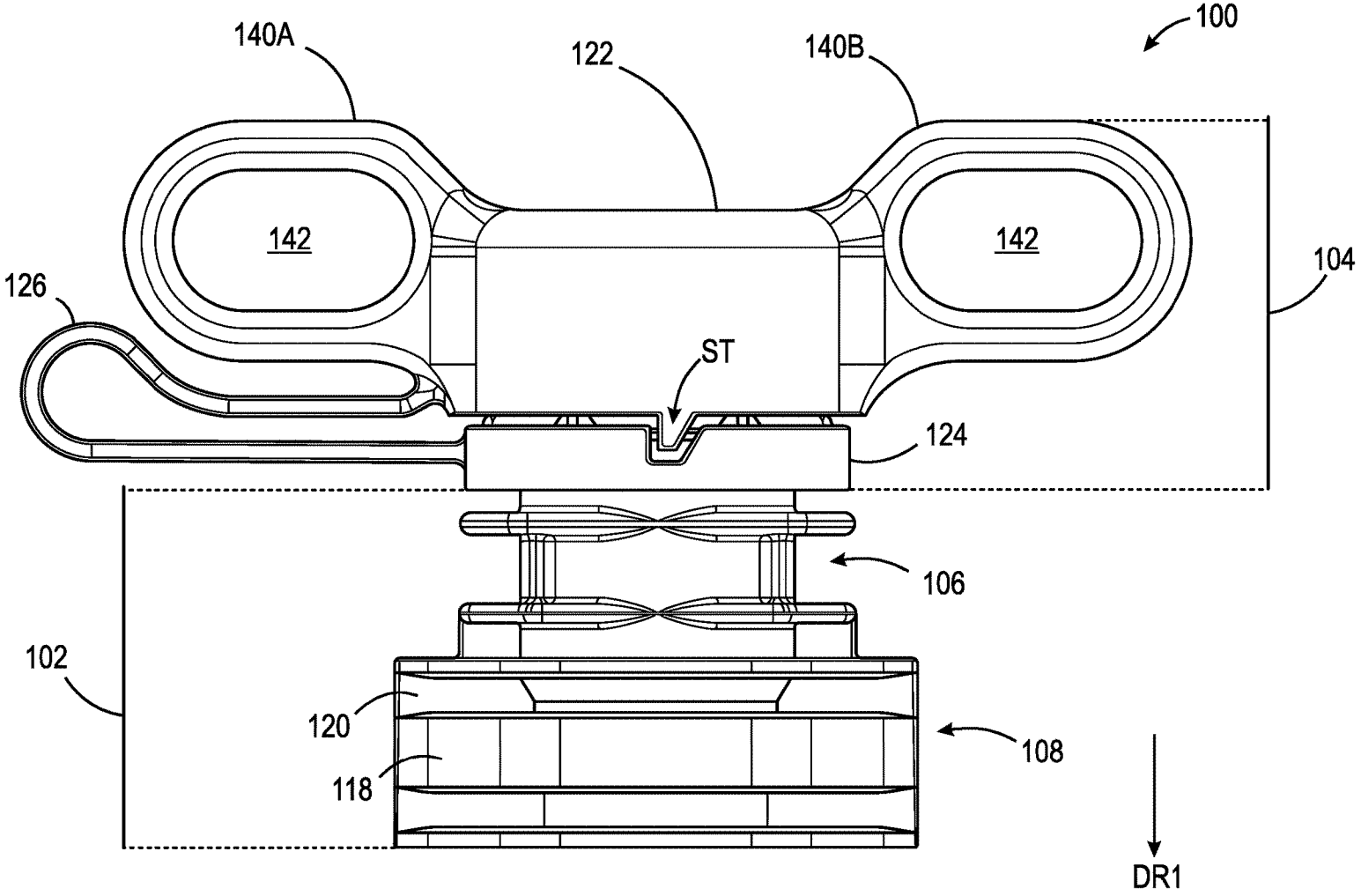
FIG. 2 is a front elevational view of a closure system in an assembled state according to the present disclosure.
Figure 3:
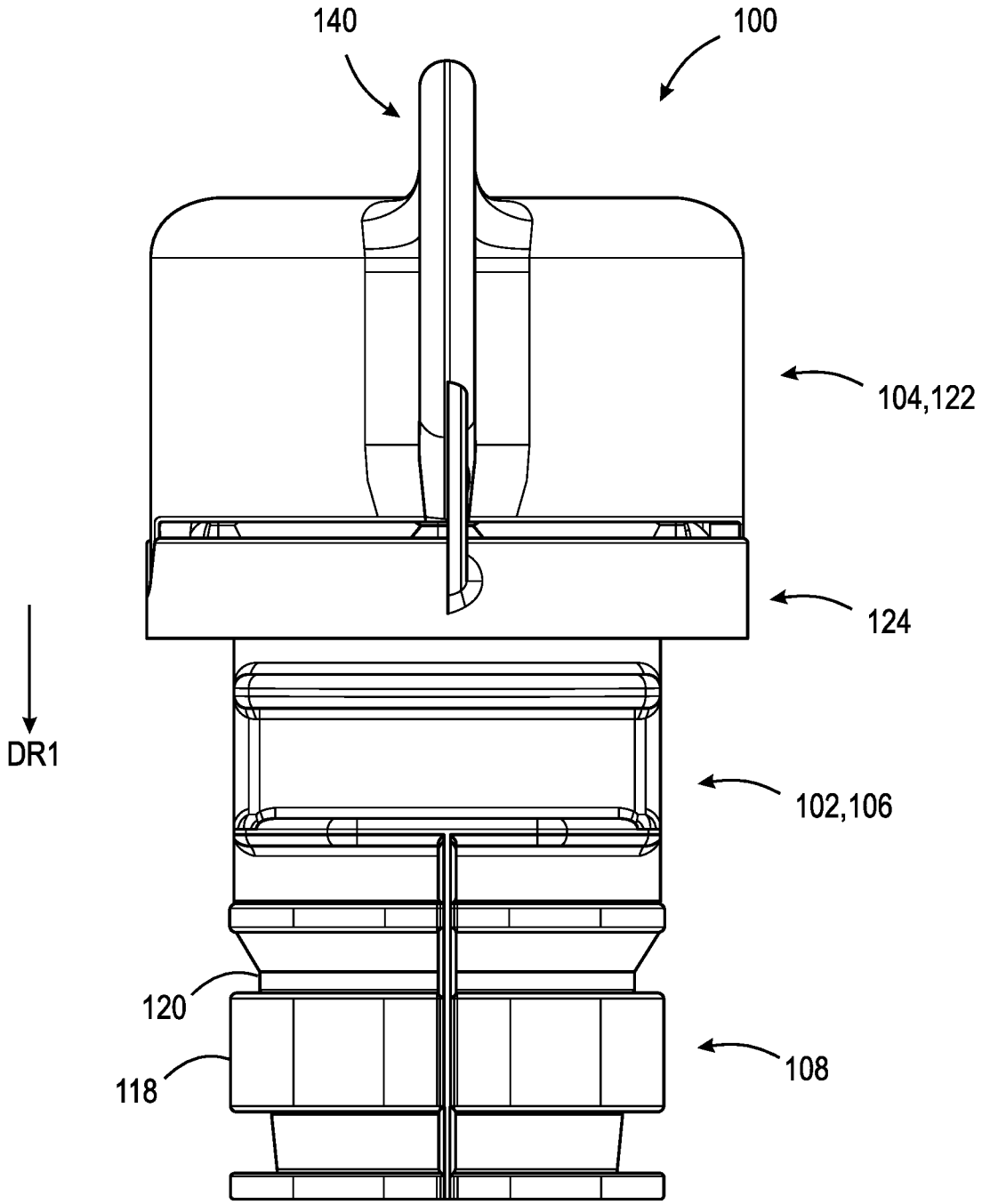
FIG. 3 is a side elevational view of a closure system in an assembled state according to the present disclosure.
Figure 4:
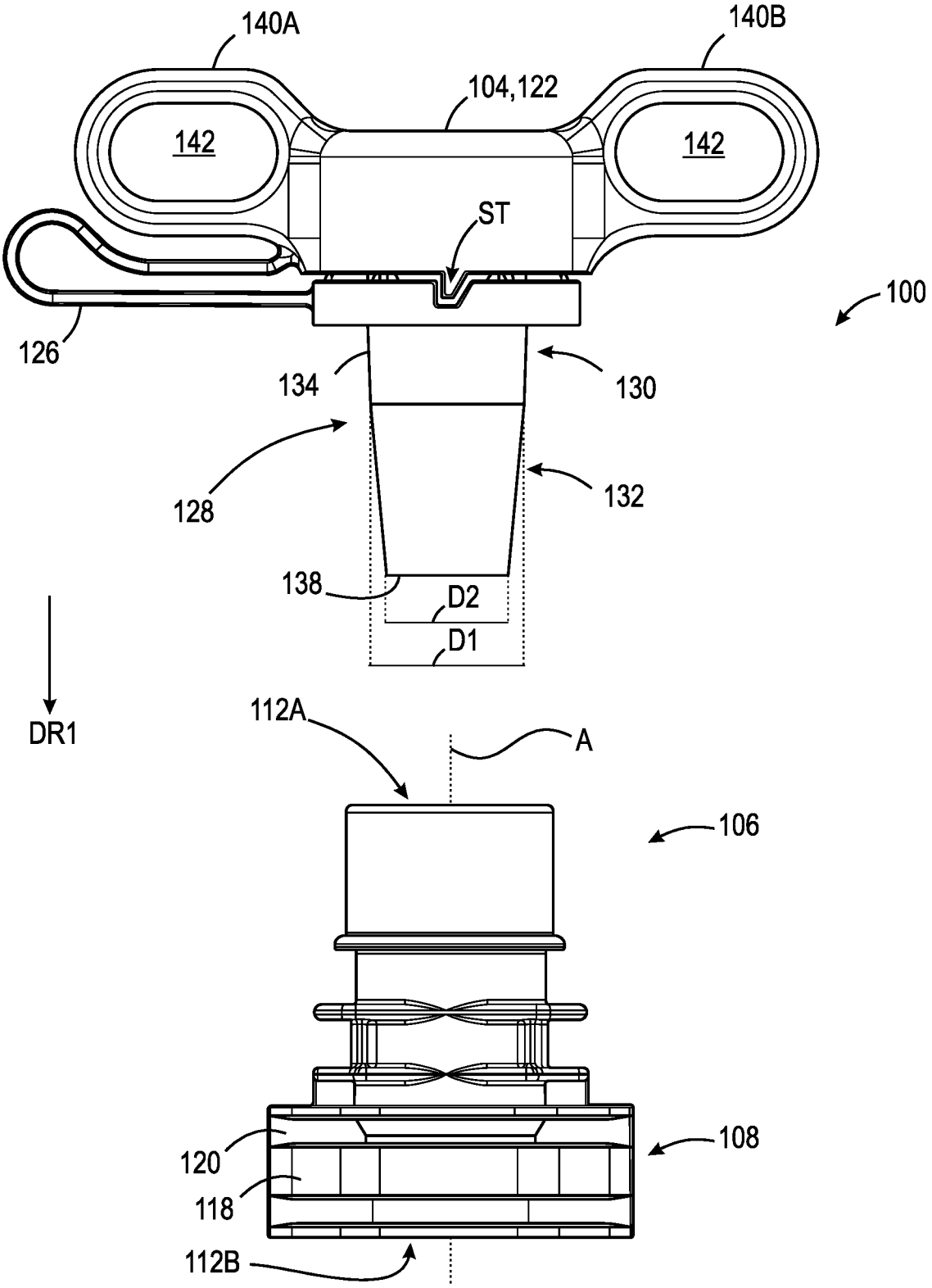
FIG. 4 is a side view of a closure system with a separated cap and spout according to the present disclosure.

As illustrated in FIGS. 2-4, closure system 100 includes a spout 102 and a cap 104. FIG. 2 illustrates a front elevational view of closure system 100 in an assembled state. FIG. 3 is a side elevational view of closure system 100 in an assembled state. FIG. 4 is a front, elevational view, of spout 102 and cap 104 where spout 102 and cap 104 have been spatially separated. As illustrated, spout 102 includes a conduit 106 and a seal member 108. Conduit 106 is intended to be a tube, straw, or other longitudinal body with an inner volume 110 (shown in FIGS. 6B and 7B) configured to provide fluid communication of foodstuffs between container C and, for example, a user's mouth when engaged with conduit 106. As used herein, and in addition to its ordinary meaning with the art, the term "fluid communication" is intended to mean the flow, movement, or transfer of a material from a first location to a second location different than the first, and can refer to the movement of solids, liquids, semi-solids, or liquids with solid parts from the first location to the second location. Although illustrated as a substantially tubular member, it should be appreciated that conduit 106 can take any substantially longitudinal shape, e.g., any shape having a first end, a second end, and a through-bore arranged between the first and second ends to provide fluid communication of foodstuffs. As shown in FIGS. 4-5, 6B, and 7B, for ease of illustration and description, conduit 106 is arranged about an imaginary axis A (hereinafter referred to as "axis A"), such that axis A extends through, and in examples where conduit 106 is tubular in shape, is concentrically centered about axis A. At each end of conduit 106, conduit 106 includes an aperture 112. As illustrated, conduit 106 includes a first aperture 112A (shown in FIGS. 4, 6B, and 7B) arranged proximate to a first end of conduit 106, where the first end of conduit 106 and thus first aperture 112A will be positioned within the user's mouth while the user is engaged with spout 102 and/or container C. As will be discussed below, conduit 106 also includes a second aperture 112B (shown in FIGS. 4-5, 6B, and 7B) arranged proximate to a second end of conduit 106, where the second end of the conduit is disposed within or secured to seal member 108 and located within container C when sealed. Additionally, in examples where conduit 106 is tubular, or has a substantially circular cross-sectional profile, the inner circumferential surface 114 of conduit 106, i.e., the surface closest to axis A, includes conduit threading 116 (shown in FIGS. 5, 6B, and 7B) configured to engage with cap threading 136 (shown in FIG. 5 and discussed below). By providing the conduit threading 116 on the inner circumferential surface 114 of conduit 106, the user's mouth does not engage with the threads when extracting foodstuffs from container C, resulting in a better overall in-mouth feel and experience for the user.

Seal member 108 is intended to be a substantially lateral member that is configured to receive and seal or otherwise permanently engage with the interior of container C. In some examples, seal member 108 includes one or more surfaces 118 configured to be fixedly secured to the container C via heat sealing, conduction sealing, induction sealing, adhesive sealing, ultrasonic bonding, welding, laser sealing, or any combination thereof. As illustrated in FIGS. 2-4, the one or more surfaces 118, include an outer contour that begins at a point of convergence at one end of seal member 108 (left side in FIGS. 2 and 4), expands to a maximum width and reduces back to another point of convergence at the opposing end of seal member 108 (right side in FIGS. 2 and 4). This contour provides an overall shape to seal member 108 that resembles a boat or canoe with a flat bottom. In some examples, as illustrated in FIGS. 2-4, the one or more surfaces 118 can each include one or more laterally disposed grooves 120 configured to provide additional surface area and increase overall adhesion between the inner surface of container C and the seal member 108 of spout 102. Seal member 108 can also include a through-bore, substantially parallel with and concentrically positioned about axis A and configured to receive and fixedly secure to conduit 106. In some examples, as illustrated in FIGS. 1-7B, conduit 106 and seal member 108 are intended to be formed as a single integral body where conduit 106 and seal member 108 are both arranged concentrically about axis A. In these examples, the second end of conduit 106 is intended to terminate at the bottom surface of seal member 108 such that second aperture 112B of conduit 106 (discussed above) is flush with the bottom surface of seal member 108.

In some examples, spout 102, i.e., both conduit 106 and seal member 108, is/are made from a thermoplastic resin material selected from at least one of: Acrylonitrile Butadiene Styrene (ABS), Acrylic, High Density Polyethylene (HDPE), Polypropylene, Polyethylene, Polystyrene, Polyvinyl Chloride (PVC), Polyethylene Terephthalate (PET), Polycarbonate, Polylactic Acid, Thermoplastic Starch, Polyhydroxyalkanoate, Polyhydroxybutyrate, Polybutylene succinate, Polyamide or any combination thereof. As will be discussed below, in some examples, seal member 108 may include one or more discrete layers of thermoplastic resin material and/or one or more layers of barrier material (e.g., second discrete layer of thermoplastic resin material 144B and second discrete layer of barrier material 146B). Additionally, as will be discussed below, conduit 106 can also include one or more discrete layers of thermoplastic resin material and/or one or more layers of barrier material (e.g., third discrete layer of thermoplastic resin material 144C and third discrete layer of barrier material 146C).

Figure 5:
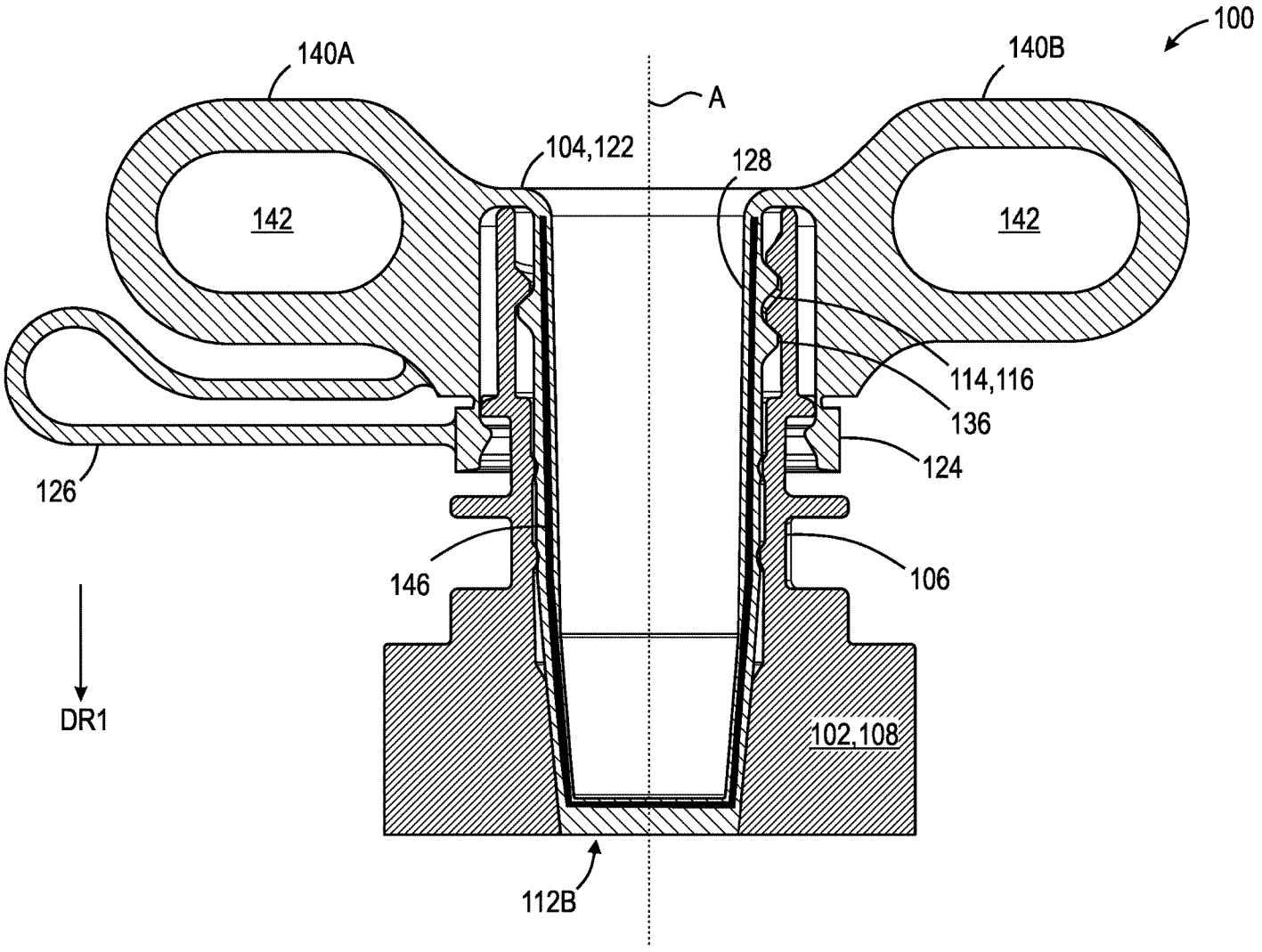
FIG. 5 is a cross-sectional view of a closure system in an assembled state taken generally down the center of cap and spout according to the present disclosure.
Figure 6A:
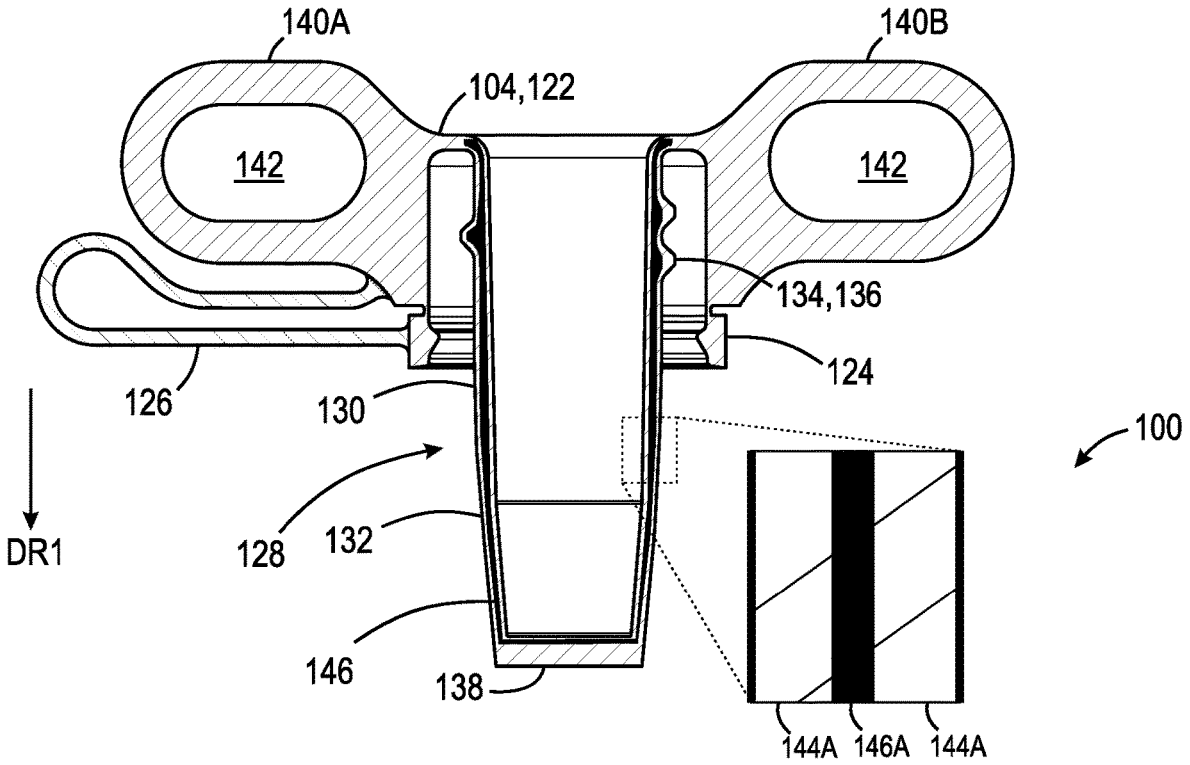
FIG. 6A is a cross-sectional view of a cap according to the present disclosure.
Figure 6B:
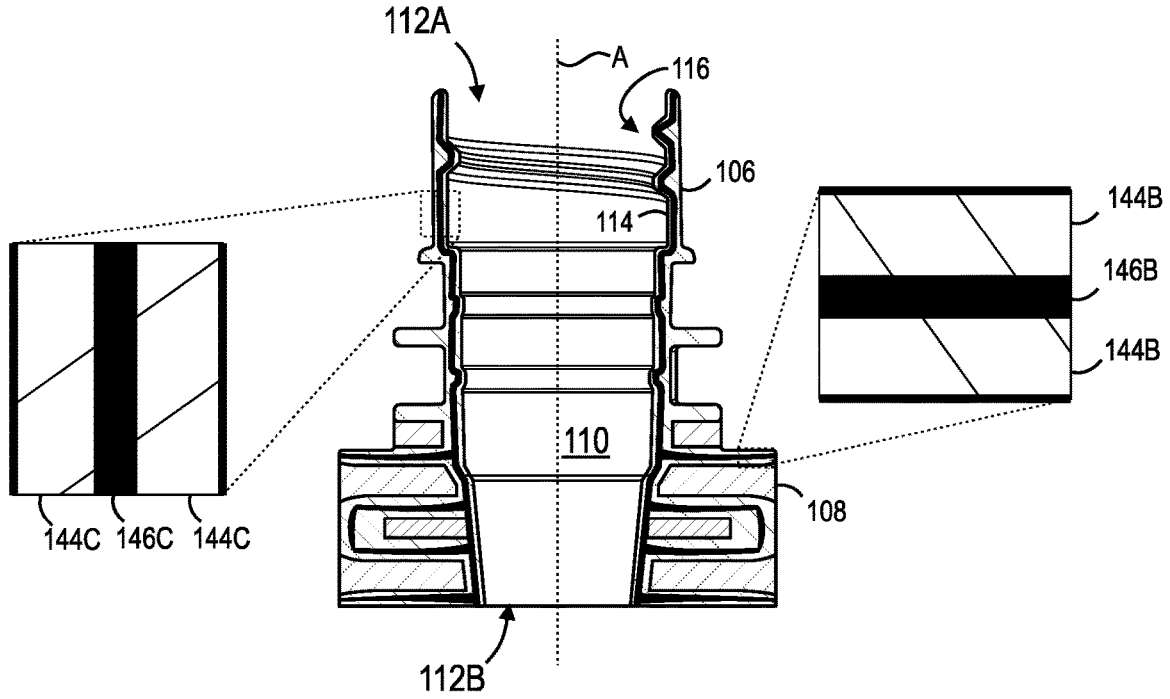
FIG. 6B is a cross-sectional view of a spout according to the present disclosure.
Figure 7A:
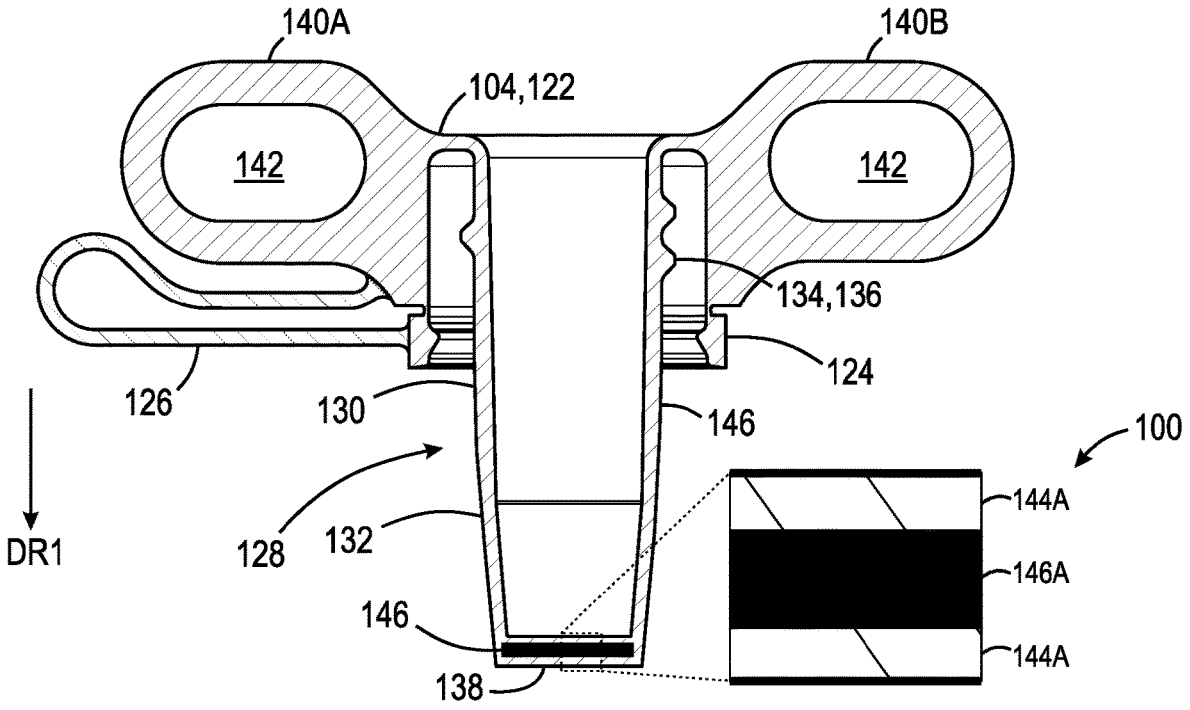
FIG. 7A is a cross-sectional view of a cap according to the present disclosure.
Figure 7B:
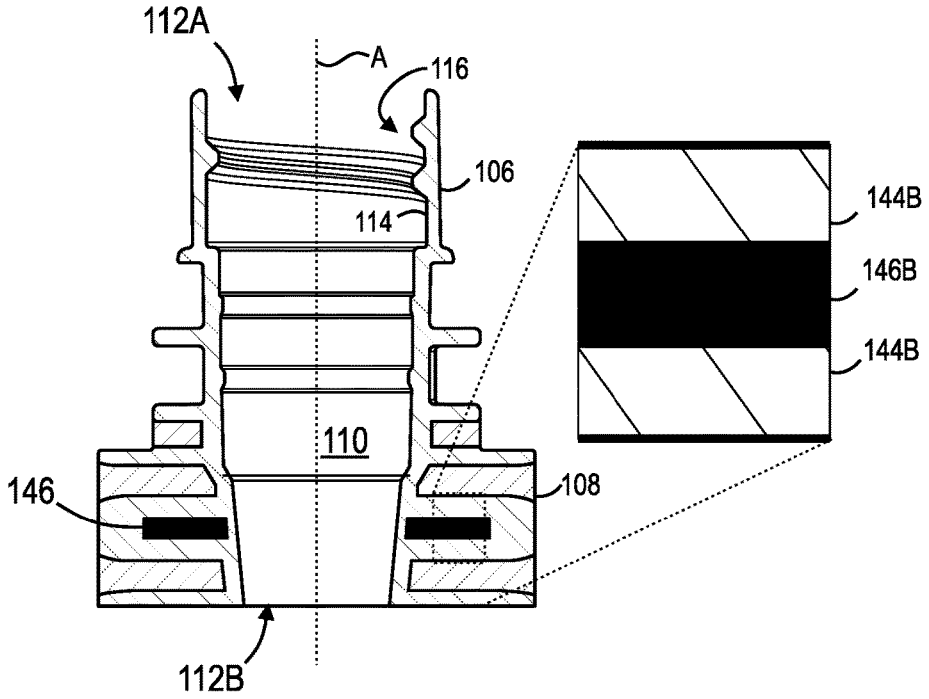
FIG. 7B is a cross-sectional view of a spout according to the present disclosure.
Figure 8:
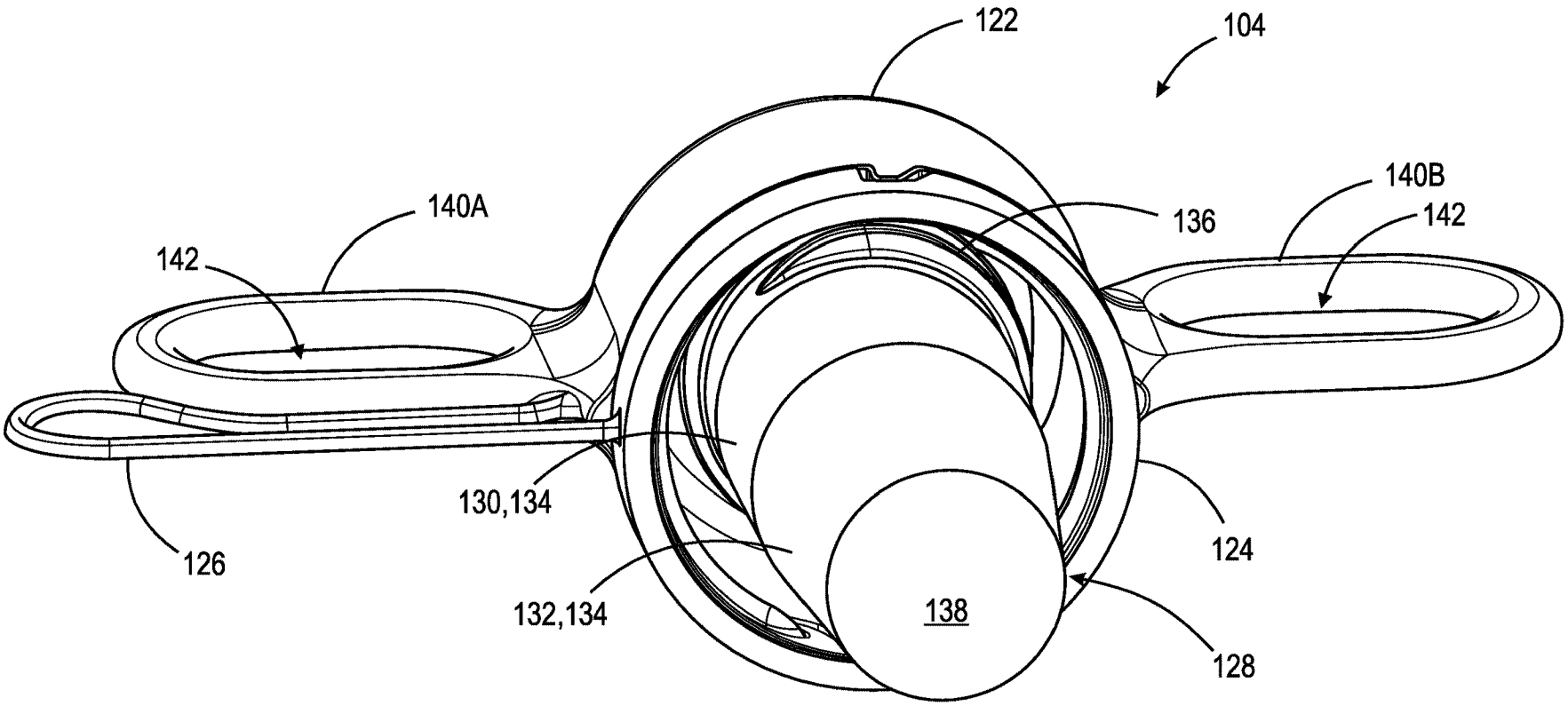
FIG. 8 is a bottom perspective view of a cap according to the present disclosure.
Figure 9:
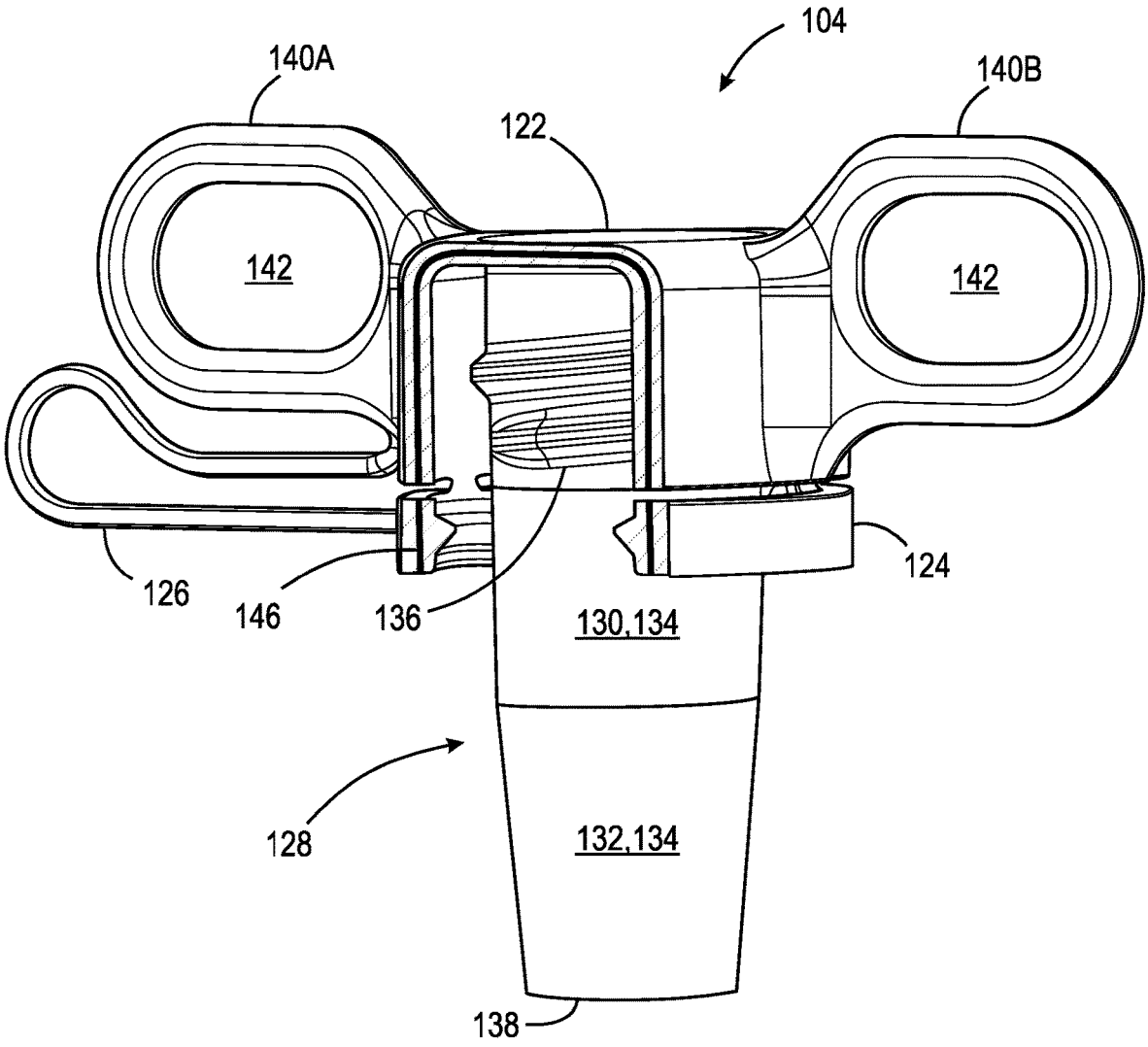
FIG. 9 is a side profile view of a cap where a portion of a body portion of the cap has been cut away to show a protrusion according to the present disclosure.

As described above and illustrated in detail in FIGS. 5-9, closure system 100 includes cap 104. FIG. 5 illustrates a front, cross-sectional, view of closure system 100 in an assembled state taken generally down the center of cap 104 and spout 102. FIG. 6A illustrates a front, cross-sectional, view of cap 104. FIG. 6B illustrates a front, cross-sectional, view of cap spout 102. FIG. 7A illustrates a front, cross-sectional, view of cap 104. FIG. 7B illustrates a front, cross-sectional, view of cap spout 102. FIG. 8 illustrates a bottom perspective view of cap 104. FIG. 9 illustrates a side profile view of cap 104 where a portion of body portion 122 (discussed below) has been cut away to show protrusion 128 (also discussed below). Cap 104 is intended to rotatingly engage and disengage from spout 102, e.g., from conduit 106, and is arranged to cover, encompass, and seal at least first aperture 112A of conduit 106 such that foodstuffs stored within container C are prevented from exiting first aperture 112A when cap 104 is engaged with spout 102. Cap 104 includes body portion 122, lower ring 124, and at least one tether 126. Body portion 122 is a substantially cylindrical body configured to encompass, cover, close, and seal first aperture 112A of conduit 106 when cap 104 is engaged with spout 102. Lower ring 124 is intended to be a ring shaped annulus and is arranged to completely radially encompass at least a portion of the vertical height of spout 102. For example, lower ring 124 is intended to completely surround or encompass at least a portion of conduit 106 and is arranged concentrically about axis A. In some examples, as shown in FIG. 5, lower ring 124 is configured to surround and rotatingly engage with a portion of conduit 106 between two externally protruding rings molded into the exterior surface of conduit 106 such that lower ring 124 stays rotatingly engaged with conduit 106 at all times after assembly. Additionally, lower ring 124 and/or body portion 122 can include one or more seal tabs ST (shown in FIGS. 2 and 4) that are made of a thin portion of material that can act as an indicator to the user that the seal has been broken and container C has been previously opened.

At least one tether 126 is configured to flexibly connect body portion 122 and lower ring 124 of cap 104 such that, in the event a user removes or disengages body portion 122 from spout 102, for example, when attempting to remove and ingest stored foodstuffs from within container C, body portion 122 is no longer preventing or sealing first aperture 112A of conduit but is still flexibly connected to conduit 106 via at least one tether 126 and lower ring 124. It should be appreciated that at least one tether 126 can be made of the same materials as body portion 122 and/or lower ring 124 (as will be discussed below) and that body portion 122, lower ring 124, and/or tether 126 can be molded or otherwise formed in a single operation or as a single unitary part.

As described above, body portion 122 is a substantially cylindrical body configured to cover and encompass at least first aperture 112A of conduit 106. Body portion 122 also includes a protrusion 128 extending in a first direction DR1, e.g., downward in at least FIGS. 5-7B, and in the direction of spout 102 when engaged with spout 102. Protrusion 128 is intended to be cylindrical or any other complementary shape to the inner circumferential surface 114 of conduit 106, and as such, is configured to fit within inner volume 110 (shown in FIGS. 6B and 7B) of conduit 106 when cap 104 is engaged with spout 102 such that a substantial portion of inner volume 110 is filled by protrusion 128. Protrusion 128 can be conceptually divided into two sections, e.g., an upper section 130 and a lower section 132 (shown in FIGS. 6A and 7A). Upper section 130 includes an outer circumferential surface 134 that includes cap threading 136 configured to rotatingly engage with conduit threading 116 (discussed above) such that body portion 122 of cap 104 rotatingly engages and disengages with the conduit 106 of spout 102 to open and close closure system 100. As such, upper section 130 has a first diameter D1 (shown in FIG. 4) that is less than the inner diameter of conduit 106 so that upper section 130 of protrusion 128 fits within inner volume 110 of conduit 106. Lower section 132 is substantially cylindrical and includes a taper from first diameter D1 to a second diameter D2 (shown in FIG. 4) where second diameter D2 is less than the first diameter D1. In some examples, the taper from the first diameter D1 to the second diameter D2 is a conical taper or Morse taper, and terminates at a flat surface 138. The Morse taper shown provides an additional level of sealing between cap 104 and spout 102 when engaged such that water or moisture is prevented from entering conduit 106 during water cooling or water-bath pasteurization. Flat surface 138 is intended to be substantially planar and arranged within a plane that is substantially orthogonal to axis A. As discussed above, and illustrated in FIG. 5, the shape and structure of protrusion 128 is configured such that protrusion 128 fills a substantial portion of inner volume 110 of conduit 106 when cap 104 is engaged with spout 102. In some examples, protrusion 128 is configured to fill approximately 50-95% of inner volume 110 of conduit 106. In other examples, protrusion 128 is configured to fill approximately 90-95% of inner volume 110 of conduit 106. In other examples, protrusion 128 is configured to fill approximately 97-100% of inner volume 110 of conduit 106.

Body portion 122 also includes at least one tab 140 configured to engage with a user such that the user can easily rotatingly disengage cap 104 from spout 102 as described above. In other words, the at least one tab 140 is configured to add a mechanical advantage to a user by increasing the available rotational leverage and increasing rotational torque when twisting or rotating cap 104. In some examples, as illustrated in FIGS. 1-2 and 4-9, body portion 122 of cap 104 includes more than one tab 140, e.g., first tab 140A and second tab 140B (collectively referred to herein as "tabs 140"), where first tab 140A and second tab 140B are diametrically opposed with each other about body portion 122 and about axis A. In some examples, body portion 122 of cap 104 as well as tabs 140 are sized and dimensioned so as to comply with United States Consumer Product Safety Commission Guidelines for small parts and toys for children's products so that cap 104, when removed from spout 102 is not a choking hazard for small children. As such, the total overall width (e.g., the dimension substantially orthogonal to axis A) of cap 104 is at least 31.75 mm (1.25 inches). Thus, in examples where cap 104 includes only a single tab 140, the length of tab 140 as it extends from the body portion 122 and the additional width of body portion 122 of cap 104 totals at least 31.75 (1.25 inches). In other examples, the length of the single tab 140 is at least 31.75 mm (1.25 inches) on its own. In examples where cap 104 includes multiple tabs 140, e.g., first tab 140A and second tab 140B, the length of each tab 140 plus the additional width of body portion 122 of cap 104 total at least 31.75 mm (1.25 inches). Additionally, in examples where body portion 122 includes tabs 140, each tab 140 can include at least one aperture 142 that operates to provide an opening for air flow, such that, in the event that a child does swallow cap 104, apertures 142 will still allow air to flow through the child's trachea preventing accidental suffocation. Additionally, the length of protrusion 128 (along a dimension substantially parallel with axis A) is at least 57.15 mm (2.25 inches).

In some examples, cap 104, i.e., both body portion 122 and protrusion 128 are made from a thermoplastic resin material selected from at least one of: Acrylonitrile Butadiene Styrene (ABS), Acrylic, High Density Polyethylene (HDPE), Polypropylene, Polyethylene, Polystyrene, Polyvinyl Chloride (PVC), Polyethylene Terephthalate (PET), Polycarbonate, Polylactic Acid, Thermoplastic Starch, Polyhydroxyalkanoate, Polyhydroxybutyrate, Polybutylene succinate, Polyamide, or any combination thereof. As will be discussed below, in some examples, cap 104 can include one or more discrete layers of thermoplastic resin material and/or one or more layers of barrier material (e.g., first discrete layer of thermoplastic resin material 144A and first discrete layer of barrier material 146A).

As described above and illustrated in FIGS. 5-7B and 9, in some examples, spout 102 and cap 104 are intended to be formed and co-extruded to include one or more discrete layers of thermoplastic resin material 144 and one or more discrete layers of a barrier material 146. As used herein, and in addition to its ordinary meaning to those in the art, the term "discrete" is intended to mean individually distinct, e.g., two discrete layers are intended to refer to a first layer and a second layer where the materials of the first layer and the materials of the second layer are potentially individually distinct from each other. Although these layers may contact each other, each layer is individually distinct from another discrete layer. As discussed above, the one or more discrete layers of thermoplastic resin material 144 can be selected from at least one of: Acrylonitrile Butadiene Styrene (ABS), Acrylic, High Density Polyethylene (HDPE), Polypropylene, Polyethylene, Polystyrene, Polyvinyl Chloride (PVC), Polyethylene Terephthalate (PET), Polycarbonate, Polylactic Acid, Thermoplastic Starch, Polyhydroxyalkanoate, Polyhydroxybutyrate, Polybutylene succinate, Polyamide, or a combination of any of the foregoing materials. Additionally, the one or more discrete layers of barrier material 146 discussed herein can be selected from at least one of: Polyamide, Ethylene Vinyl Alcohol (EVOH), Polyvinyl Alcohol, Thermoplastic Starch, cellulose nano crystals, nano clay, or any combination thereof. As will be discussed below, in some examples, a barrier layer is provided within only the seal member 108, while in other examples, a barrier layer is provided in the seal member 108 and the cap 104, while in further examples, a barrier layer is provided in conduit 106, seal member 108, and cap 104. In all examples, the one or more discrete layers of barrier material are intended to hinder, and in some cases entirely prevent, the migration of external substances, e.g., oxygen or moisture, from entering closure system 100 and/or container C and spoiling or otherwise altering the foodstuffs stored within container C.

As illustrated in FIGS. 5-6B and 9, in example embodiments where cap 104 includes a discrete layer of barrier material 146, the barrier material can be disposed as a discrete strip of barrier material that is present within the entire body portion 122 and protrusion 128 of cap 104, e.g., the discrete barrier layer is present within each portion of cap 104 spanning at least the width and length of protrusion 128 and/or the width and length of body portion 122. Similarly, in example embodiments where spout 102 includes a discrete layer of barrier material 146, the barrier material can be disposed as a strip of barrier material that is present throughout conduit 106 and/or seal member 108, e.g., the discrete barrier layer is present within the walls defining the conduit 106 and/or within the seal member 108 disposed along the seal member's entire width and length.

In some examples as illustrated in FIGS. 7A-7B, portions of spout 102 and/or portions of cap 104 can contain the discrete layers of barrier material 146 discussed herein, while the remaining portions of each respective component can be substantially free of barrier material. For example, FIG. 7A shows a discrete layer of barrier material 146 disposed within the second end of protrusion 128 of cap 104. The barrier material 146 is arranged as a flat or planar layer of material disposed proximate to and substantially parallel with flat surface 138. As illustrated, the rest of protrusion 128 and/or the rest of body portion 122 of cap 104 are free from barrier materials. However, it should be appreciated that cap 104 can include additional barrier material that is blended or mixed with the thermoplastic resin material to form a uniformly blended material. Additionally, as shown in FIG. 7B, one or more discrete layers of barrier material 146 can be disposed within seal member 108 of spout 102. The barrier material 146 illustrated is arranged as one or more flat or planar layers of material disposed substantially parallel with flat surface 138 of protrusion 128 when in an assembled state. As illustrated, the rest of spout, e.g., the rest of conduit 106 and the rest of seal member 108 are free from barrier materials. However, it should be appreciated that, in some examples, conduit 106 and/or the rest of seal member 108 can include additional barrier material that is blended or mixed with the thermoplastic resin material to form a uniformly blended material.

Although not specifically illustrated, it should be appreciated that the cap 104 illustrated in FIG. 6A and the spout 102 illustrated in FIG. 7B can be combined into one example embodiment of closure system 100. For example, As illustrated in FIG. 6A, cap 104 can include a discrete layer of barrier material 146 disposed throughout the body portion 122 and protrusion 128 of cap 104, while spout 102 (shown in FIG. 7B) one or more discrete layers of barrier material 146 can be disposed within only seal member 108 of spout 102. As shown, the barrier material 146 illustrated is arranged as one or more flat or planar layers of material disposed substantially parallel with flat surface 138 of protrusion 128 when in an assembled state. Additionally, the rest of spout, e.g., the rest of conduit 106 and the rest of seal member 108 are free from barrier materials. However, it should be appreciated that, in some examples, conduit 106 and/or the rest of seal member 108 can include additional barrier material that is blended or mixed with the thermoplastic resin material.

Although not specifically illustrated, in one example of closure system 100, cap 104 includes a discrete barrier layer between one or more discrete layers of thermoplastic resin material. Specifically, body portion 122, including protrusion 128, is formed in a co-extrusion process where a first discrete layer of thermoplastic resin 144A (shown in FIGS. 6A and 7A) is co-extruded with a first discrete layer of barrier material 146A (also shown in FIGS. 6A and 7A). As described above, the first discrete layer of barrier material 146A can be disposed as a discrete strip of barrier material throughout all of cap 104 (as shown in FIG. 6A) or can be disposed within only a portion of cap 104, e.g., only within the second end of protrusion 128 of cap 104 (as shown in FIG. 7A). In this example, spout 102 can be made of a thermoplastic resin material and does not include a discrete layer of barrier material. It should be appreciated that in this example embodiment, spout 102 can include a barrier material that is blended or mixed with the thermoplastic resin material to form a uniformly blended material, or spout 102 can include only thermoplastic resin material with no added barrier material. In this example, the addition of the first discrete layer of barrier material 146A within only cap 104 operates to limit migration of external substances that could negatively affect the foodstuffs stored within container C. Thus, when closure system 100 is fixedly secured to container C, for example, through heat or induction sealing between an inside surface of container C and the one or more surfaces 118 of seal member 108, any potential migration of oxygen through cap 104 is minimized and/or eliminated entirely, preventing spoilage of the foodstuffs within container C.

Although not specifically illustrated, in another example of closure system 100, cap 104 includes a discrete barrier layer between one or more discrete layers of thermoplastic resin material, and seal member 108 of spout 102 includes a discrete barrier layer between one or more discrete layers of thermoplastic resin. Specifically, body portion 122, including protrusion 128, is formed with a first discrete layer of thermoplastic resin 144A (shown in FIGS. 6A and 7A) co-extruded with a first discrete layer of barrier material 146A (also shown in FIGS. 6A and 7A). As described above, the first discrete layer of barrier material 146A can be disposed as a discrete strip of barrier material throughout all of cap 104 (as shown in FIG. 6A) or can be disposed within only a portion of cap 104, e.g., only within the second end of protrusion 128 of cap 104 (as shown in FIG. 7A). Additionally, seal member 108 is formed with a second discrete layer of thermoplastic resin 144B (shown in FIGS. 6B and 7B) co-extruded with a second discrete layer of barrier material 146B (shown in FIGS. 6B and 7B). As described above, the second discrete layer of barrier material 146B can be disposed as a discrete strip of barrier material throughout all of seal member 108 (as shown in FIG. 6B) or can be disposed within only a portion of seal member 108, e.g., by one or more discrete layers disposed within the center or middle of seal member 108 (as shown in FIG. 7B). In this example, conduit 106 of spout 102 can be made of a thermoplastic resin material and does not include a discrete layer of barrier material. It should be appreciated that in this example embodiment, conduit 106 of spout 102 can include a barrier material that is blended or mixed with the thermoplastic resin material to form a uniformly blended material, or conduit 106 can include only thermoplastic resin material with no added barrier material. In this example, the combination of first discrete layer of barrier material 146A within cap 104 and second discrete layer of barrier material 146B of seal member 108 operate to further limit migration of external substances that could negatively affect the foodstuffs stored within container C. Thus, when closure system 100 is fixedly secured to container C, for example, through heat or induction sealing between an inside surface of container C and the one or more surfaces 118 of seal member 108, any potential migration of oxygen through cap 104 and seal member 108 is minimized and/or eliminated entirely, preventing spoilage of the foodstuffs within container C.

Although not specifically illustrated, in yet another example of closure system 100, cap 104 includes a discrete barrier layer between one or more discrete layers of thermoplastic resin material, and conduit 106 of spout 102 includes a discrete barrier layer between one or more discrete layers of thermoplastic resin. Specifically, body portion 122, including protrusion 128, is formed with a first discrete layer of thermoplastic resin 144A (shown in FIGS. 6A and 7A) co-extruded with a first discrete layer of barrier material 146A (also shown in FIGS. 6A and 7A). As described above, the first discrete layer of barrier material 146A can be disposed as a discrete strip of barrier material throughout all of cap 104 (as shown in FIG. 6A) or can be disposed within only a portion of cap 104, e.g., only within the second end of protrusion 128 of cap 104 (as shown in FIG. 7A). Additionally, conduit 106 is formed with a third discrete layer of thermoplastic resin 144C (shown in FIG. 6B) co-extruded with a third discrete layer of barrier material 146C (shown in FIG. 6B). In this example, seal member 108 of spout 102 can be made of a thermoplastic resin material and does not include a discrete layer of barrier material. It should be appreciated that in this example embodiment, seal member 108 of spout 102 can include a barrier material that is blended or mixed with the thermoplastic resin material to form uniformly blended material, or seal member 108 can include only thermoplastic resin material with no added barrier material. In this example, the combination of first discrete layer of barrier material 146A within cap 104 and third discrete layer of barrier material 146C of conduit 106 operate to further limit migration of external substances that could negatively affect the foodstuffs stored within container C. Thus, when closure system 100 is fixedly secured to container C, for example, through heat or induction sealing between an inside surface of container C and the one or more surfaces 118 of seal member 108, any potential migration of oxygen through cap 104 and conduit 106 is minimized and/or eliminated entirely, preventing spoilage of the foodstuffs within container C.

As illustrated in FIGS. 6A-6B, in one example of closure system 100, each of cap 104, conduit 106, and seal member 108 includes a discrete barrier layer between one or more discrete layers of thermoplastic resin material. Specifically, body portion 122, including protrusion 128, is formed with a first discrete layer of thermoplastic resin 144A (shown in FIGS. 6A and 7A) co-extruded with a first discrete layer of barrier material 146A (also shown in FIGS. 6A and 7A). As described above, the first discrete layer of barrier material 146A can be disposed as a discrete strip of barrier material throughout all of cap 104 (as shown in FIG. 6A) or can be disposed within only a portion of cap 104, e.g., only within the second end of protrusion 128 of cap 104 (as shown in FIG. 7A). Additionally, seal member 108 is formed with a second discrete layer of thermoplastic resin 144B (shown in FIGS. 6B and 7B) co-extruded with a second discrete layer of barrier material 146B (shown in FIGS. 6B and 7B). As described above, the second discrete layer of barrier material 146B can be disposed as a discrete strip of barrier material throughout all of seal member 108 (as shown in FIG. 6B) or can be disposed within only a portion of seal member 108, e.g., by one or more discrete layers disposed within the center or middle of seal member 108 (as shown in FIG. 7B). Furthermore, conduit 106 is formed with a third discrete layer of thermoplastic resin 144C (shown in FIG. 6B) co-extruded with a third discrete layer of barrier material 146C (shown in FIG. 6B). In this example, the combination of first discrete layer of barrier material 146A within cap 104, the second discrete layer of barrier material 146B in seal member 108, and third discrete layer of barrier material 146C of conduit 106 operate to further limit migration of external substances that could negatively affect the foodstuffs stored within container C. Thus, when closure system 100 is fixedly secured to container C, for example, through heat or induction sealing between an inside surface of container C and the one or more surfaces 118 of seal member 108, any potential migration of oxygen through cap 104, conduit 106, and seal member 108 is minimized and/or eliminated entirely, preventing spoilage of the foodstuffs within container C.

Although some of the illustrated figures show the respective layers of barrier material centered between both external surfaces of, e.g., cap 104 or conduit 106, it should be appreciated that the barrier material can be positioned as close as possible to the interior surface of a given component while also maintaining at least a portion of thermoplastic resin material between the barrier material and the foodstuffs within container C. This provides the most migration mitigation while not exposing the barrier material to foodstuffs directly. Additionally, by providing a discrete layer of barrier material in one or more of the components discussed above or within only a portion of the one or more components discussed above, e.g., in cap 104, conduit 106, and/or seal member 108, closure system 100 provides superior mitigation of migration of oxygen while reducing the amount of barrier material required to prevent said migration. Initial observations have revealed that approximately half of the oxygen migration from outside of container C to inside of container C is allowed by typical spouts or straws. Thus, by providing a discrete layer of barrier material substantially perpendicular to the conduit 106 and/or axis A, within seal member 108 and/or within cap 104, this migration is significantly reduced and/or eliminated.

The internal thread orientation discussed above, e.g., by providing the conduit threading 116 on the inner circumferential surface 114 of conduit 106, the exterior wall of conduit 106, i.e., the surface that a user's mouth would contact when extracting the contents of container C through conduit 106, can be entirely smooth providing a more satisfying in-mouth feel to the user over conduits or spouts that have external threads. Additionally, the orientation of conduit threading 116 and cap threading 136 prevents moisture/water accumulation during or after any pasteurization processes.

Furthermore, protrusion 128 fills a substantial portion or all of internal volume 110 of conduit 106 which limits or substantially lessens oxygen present in the internal volume 110 of conduit 106 that may have accumulated during the manufacturing, forming, or filling process that can significantly contribute to the spoiling of foodstuffs or negatively effect a pasteurization process of the foodstuffs.

Figure 10:
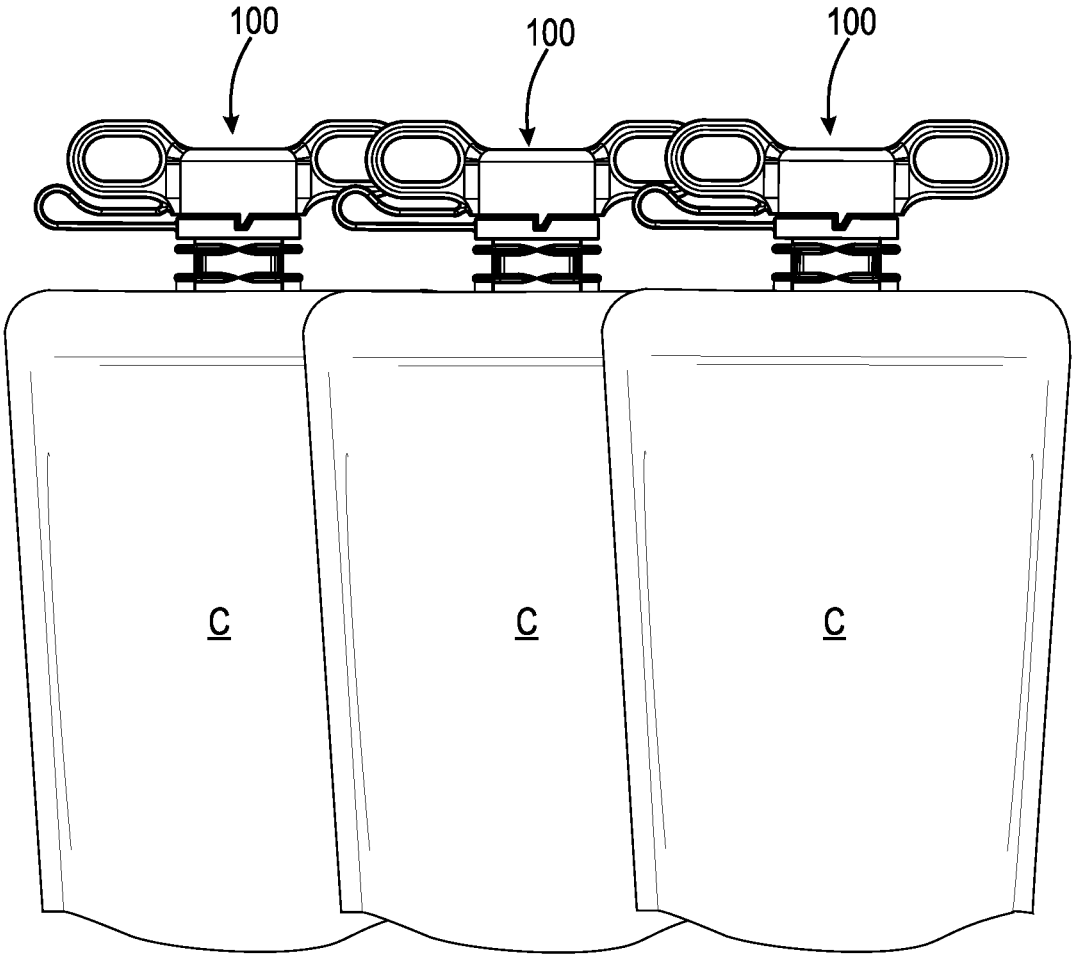
FIG. 10 is a front perspective view of a plurality of containers and closure systems according to the present disclosure.

Additionally, the closure system 100 described herein provides a narrow overall design that reduces overall cap size while maintaining sufficient length and width dimensions to avoid the cap 104 from being a choking hazard for children. Additionally, during shipping and while being display in a retail setting, the narrow design allows for substantial lateral overlap between any two adjacent containers C with closure system 100 (shown in FIG. 10). For example, as shown, the design may allow for 0-50% lateral overlap between two adjacent containers C, allowing for a higher packing efficiency for shipping and product display.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

What is claimed is:

1. A closure system for containers of foodstuffs, the system comprising:

a spout, the spout comprising a conduit and a seal member, the conduit arranged about an imaginary axis and the seal member having one or more surfaces configured to be secured to a container, wherein the conduit comprises conduit threading disposed on an inner circumferential surface of the conduit; and a cap having an inner circumferential surface, the inner circumferential surface arranged to encompass the conduit, the cap comprising a first discrete layer of thermoplastic resin and a first discrete layer of barrier material, wherein the first discrete layer of barrier material is surrounded by the first discrete layer of thermoplastic resin, wherein the cap has a protrusion extending in a first direction, wherein the protrusion is arranged to substantially fill an inner volume of the conduit, wherein the protrusion comprises at least a portion of the first discrete layer of barrier material, wherein an upper section of the protrusion includes first cap threading configured to engage with the conduit threading of the conduit, wherein the at least a portion of the first discrete layer of barrier material extends throughout and within the cap threading such that the first discrete layer of barrier material has thicker portions inside of the cap threading than outside of the cap threading;

wherein the conduit comprises a second discrete layer of thermoplastic resin and a second discrete layer of barrier material, and wherein the second discrete layer of barrier material is vertically disposed throughout a length of the conduit surrounded by the seal member, wherein the seal member comprises a third discrete layer of thermoplastic resin and a third discrete layer of barrier material, and wherein the third discrete layer of barrier material is disposed within the seal member, wherein the one or more surfaces of the seal member comprise one or more laterally disposed grooves arranged concentrically with the conduit about the imaginary axis and configured to be secured to the container.

2. The closure system of claim 1, wherein the third discrete layer of barrier material includes at least one lateral portion.

3. The closure system of claim 1, wherein one or more surfaces of the seal member are secured to the container via heat sealing, conduction sealing, induction sealing, adhesive sealing, ultrasonic bonding, welding, laser sealing, or any combination thereof.

4. The closure system of claim 1, wherein the first discrete layer of thermoplastic resin is selected from at least one of: Acrylonitrile Butadiene Styrene (ABS), Acrylic, High Density Polyethylene (HDPE), Polypropylene, Polyethylene, Polystyrene, Polyvinyl Chloride (PVC), Polyethylene Terephthalate (PET), Polycarbonate, Polylactic Acid, Thermoplastic Starch, Polyhydroxyalkanoate, Polyhydroxybutyrate, Polybutylene succinate, Polyamide or any combination thereof.

5. The closure system of claim 1, wherein the first discrete layer of barrier material is selected from at least one of: Polyamide, Ethylene Vinyl Alcohol (EVOH), Polyvinyl Alcohol, Thermoplastic Starch, cellulose nano crystals, nano clay, or any combination thereof.

6. The closure system of claim 1, wherein a lower section of the protrusion includes a morse taper from a first diameter to a second diameter less than the first diameter.

7. The closure system of claim 1, wherein the protrusion terminates at a flat surface substantially orthogonal with the imaginary axis.

8. The closure system of claim 1, wherein the cap has a lower ring configured to engage with the conduit and/or the seal member, and a body portion configured to engage with and close an aperture of the conduit.

9. The closure system of claim 8, wherein the lower ring is secured to the body portion via one or more tethers.

10. The closure system of claim 9, wherein the one or more tethers are integrally formed with the lower ring and the body portion of the cap.

11. The closure system of claim 8, wherein the body portion of the cap includes one or more tabs.

12. The closure system of claim 11, wherein the one or more tabs each include an aperture.

13. The closure system of claim 11, wherein the one or more tabs measure at least 31.75 mm in length.

14. The closure system of claim 1, wherein the container comprises a container barrier material or a discrete layer of container barrier material.

15. A closure system for containers of foodstuffs, the system comprising:

a spout, the spout comprising a conduit and a seal member, the conduit arranged about an imaginary axis and the seal member having one or more surfaces configured to be secured to a container, wherein the conduit comprises conduit threading disposed on an inner circumferential surface of the conduit; and a cap having an inner circumferential surface, the inner circumferential surface arranged to encompass the conduit, the cap comprising a first discrete layer of thermoplastic resin and a first discrete layer of barrier material, wherein the first discrete layer of barrier material is surrounded by the first discrete layer of thermoplastic resin, wherein the cap has a protrusion extending in a first direction, wherein the protrusion is arranged to substantially fill an inner volume of the conduit, wherein the protrusion comprises at least a portion of the first discrete layer of barrier material, wherein an upper section of the protrusion includes first cap threading configured to engage with the conduit threading of the conduit, wherein the at least a portion of the first discrete layer of barrier material extends throughout and within the first cap threading such that the first discrete layer of barrier material has thicker portions inside of the cap threading than outside of the cap threading;

wherein the seal member comprises a second discrete layer of thermoplastic resin and a second discrete layer of barrier material, wherein the second discrete layer of barrier material is disposed within the seal member, wherein the one or more surfaces of the seal member comprise one or more laterally disposed grooves arranged concentrically with the conduit about the imaginary axis and configured to be secured to the container, wherein the conduit comprises a third discrete layer of thermoplastic resin and a third discrete layer of barrier material, wherein the third discrete layer of barrier material is vertically disposed throughout a length of the conduit surrounded by the seal member.

16. The closure system of claim 15, wherein a lower section of the protrusion includes a morse taper from a first diameter to a second diameter less than the first diameter, wherein the protrusion terminates at a flat surface that is substantially orthogonal with the imaginary axis.

17. The closure system of claim 15, wherein the cap has a lower ring configured to engage with the conduit and/or the seal member, and a body portion configured to engage with and close an aperture of the conduit.

18. The closure system of claim 17, wherein the lower ring is secured to the body portion via one or more tethers and wherein the one or more tethers are integrally formed with the lower ring and the body portion of the cap.

19. The closure system of claim 15, wherein the thermoplastic resin of the first discrete layer of thermoplastic resin or the second discrete layer of thermoplastic resin is selected from at least one of: Acrylonitrile Butadiene Styrene (ABS), Acrylic, High Density Polyethylene (HDPE), Polypropylene, Polyethylene, Polystyrene, Polyvinyl Chloride (PVC), Polyethylene Terephthalate (PET), Polycarbonatepolylactic Acid, Thermoplastic Starch, Polyhydroxyalkanoate, Polyhydroxybutyrate, Polybutylene succinate, Polyamide, or any combinations thereof; and wherein the barrier material of first discrete layer of barrier material and the second discrete layer of barrier material is selected from at least one of: Polyamide, Ethylene Vinyl Alcohol (EVOH), Polyvinyl Alcohol, Thermoplastic Starch, Cellulose nano crystals, nano clay, or any combination thereof.

20. The closure system of claim 15, wherein the second discrete layer of barrier material of the seal member comprises at least one lateral portion.

21. The closure system of claim 8, wherein the lower ring is rotationally engaged with a portion of the conduit between two externally protruding rings molded into an exterior surface of the conduit, and wherein the lower ring comprises a fourth discrete layer of barrier material.

22. The closure system of claim 17, wherein the lower ring is rotationally engaged with a portion of the conduit between two externally protruding rings molded into an exterior surface of the conduit, and wherein the lower ring comprises a fourth discrete layer of barrier material.

* * * * *